US005119648A

United States Patent [19]

Bertucci et al.

[11] Patent Number: 5,119,648

[45] Date of Patent: Jun. 9, 1992

[54] MACHINE FOR SINGLE-PASS HIDE SKIVING

[75] Inventors: Franco Bertucci, Ramiseto; Raffaele Facchi, Modena, both of Italy

[73] Assignee: S.p.A. Luigi Rizzi & C., Modena, Italy

[21] Appl. No.: 580,067

[22] Filed: Sep. 10, 1990

[30] Foreign Application Priority Data

Sep. 14, 1989 [IT] Italy ..... 41698 A/89

[51] Int. Cl.[5] ..... C14B 1/22

[52] U.S. Cl. ..... 69/9.5; 69/9; 69/21.5

[58] Field of Search ..... 69/9, 9.1, 9.3, 9.5, 69/10, 11, 12, 13, 15, 16, 21.5

[56] References Cited

U.S. PATENT DOCUMENTS 4,253,318 3/1981 Repetto ..... 69/9.1
4,338,803 7/1982 Paccagnella ..... 69/16

FOREIGN PATENT DOCUMENTS 317895 5/1989 European Pat. Off. ..... 69/9
1660111 6/1978 Fed. Rep. of Germany ..... 69/9.1
2579225 9/1986 France ..... 69/9
2586707 3/1987 France ..... 69/13

*Primary Examiner*—Werner H. Schroeder
*Assistant Examiner*—Michael A. Neas
*Attorney, Agent, or Firm*—Guido Modiano; Albert Josif

[57] ABSTRACT

The single-pass hide skiving machine includes a supporting structure (1) which rotatably supports a motorized cylinder (2). A first oscillating frame (3) rotatably supports a support cylinder (4) which is arrangeable in a working position below and slightly forward of the motorized cylinder. A second oscillating frame (8) rotatably supports a first bladed cylinder (9) which is arrangeable in a working position slightly rearward of the support cylinder. Arranged above and slightly forward of the motorized cylinder is a second bladed cylinder (31). Additionally, a contrast cylinder (18), kinematically connected to the support cylinder (4) by rollers (17), is movable into a working position between the support cylinder (4) and the second bladed cylinder (31). A hide is initially fed through the motorized cylinder and support cylinder and then through the first bladed cylinder (9) and the support cylinder (4) to effect the skiving. Selected skiving of the hide is possible by movement of the contrast cylinder (18) into its working position.

11 Claims, 7 Drawing Sheets

MACHINE FOR SINGLE-PASS HIDE SKIVING

BACKGROUND OF THE INVENTION

The present invention relates to a machine for single-pass hide skiving.

Machines are known in hide processing, and commercially available, for skiving hides on the side commonly termed "split", so as to give the hide a constant thickness, removing lumps or thickenings.

Known machines comprise a frame with two opposite sides which support a motorized support cylinder and two oscillating frames, a first lower one which is arranged behind said support cylinder and supports a first bladed cylinder and a second one which is arranged in front and supports a second bladed cylinder.

Each of the two oscillating frames is movable independently of the other between an idle position, in which the respective bladed cylinder is spaced from the support cylinder, and a working position, in which the bladed cylinder is close to the support cylinder and is in working contact on a hide arranged thereon.

A presser roller is also supported between the sides, is arranged between said bladed cylinders and is movable between a raised position and a lowered position in contact with the hide being processed.

Processing comprises a first step of loading the hide on the motorized support cylinder with only the first bladed cylinder close thereto.

In a second step, the presser roller is lowered, clamps the hide against the support cylinder and causes it to advance toward the first bladed cylinder, starting the skiving and usually continuing it until the brisket is at the support cylinder.

At this point the second bladed cylinder is lowered to the working position, performing the skiving of the hide simultaneously with the first bladed cylinder, which is raised and stopped when the point is reached, where the skiving of the second cylinder started.

Upon completion of the skiving, the hide passes beyond the presser roller and drops into the lower region of the machine.

Though this type of machine constitutes a considerable improvement with respect to preceding machines, it is however not free from disadvantages, an important one being that the action of the second bladed cylinder causes a traction on the hide and the consequent breakage of the brisket and of the tip of the foreleg which are skived last.

SUMMARY OF THE INVENTION

The aim of the present invention is to provide a machine which, by allowing to skive the hide in a single pass, eliminates the possibility that parts thereof may tear during processing.

A consequent primary object is to provide a machine which allows to minimize hide processing waste.

Another important object is to provide a machine which does not require manual interventions on the hide after loading.

Not least object is to provide a machine which can be manufactured with conventional production systems.

This aim, these objects and others which will become apparent hereinafter are achieved by a hide skiving machine, characterized in that it comprises a supporting structure with two supporting sides, a driving cylinder and two lower oscillating frames rotatably coupled to said sides. A first one of said frames being arranged frontally and supporting a rotatable support cylinder adapted to cooperate with said driving cylinder for advancing a hide arranged therebetween. A second one of said frames being arranged rearward and supporting a first bladed rotating cylinder adapted to make contact with said hide in a position close to said support cylinder. A third frame being associated with said first frame so as to be able to oscillate. Said third frame supporting a contrast cylinder which is kinematically connected to said first support cylinder by means of a row of rollers interposed therebetween. Said third frame moving the contrast cylinder and the rollers so that they interpose themselves between said support cylinder during the processing of the hide, arranging them with their axes on a plane which is substantially radial with respect to said support cylinder, and a second bladed rotating cylinder rigidly associated with the supporting structure in a preset frontward position above said driving cylinder.

BRIEF DESCRIPTION OF THE DRAWINGS

Further characteristics and advantages will become apparent from the detailed description of an embodiment of the invention, illustrated only by way of non-limitative example in the accompanying drawings, wherein.

DESCRIPTION OF THE PREFERRED EMBODIMENTS

Figure 1:
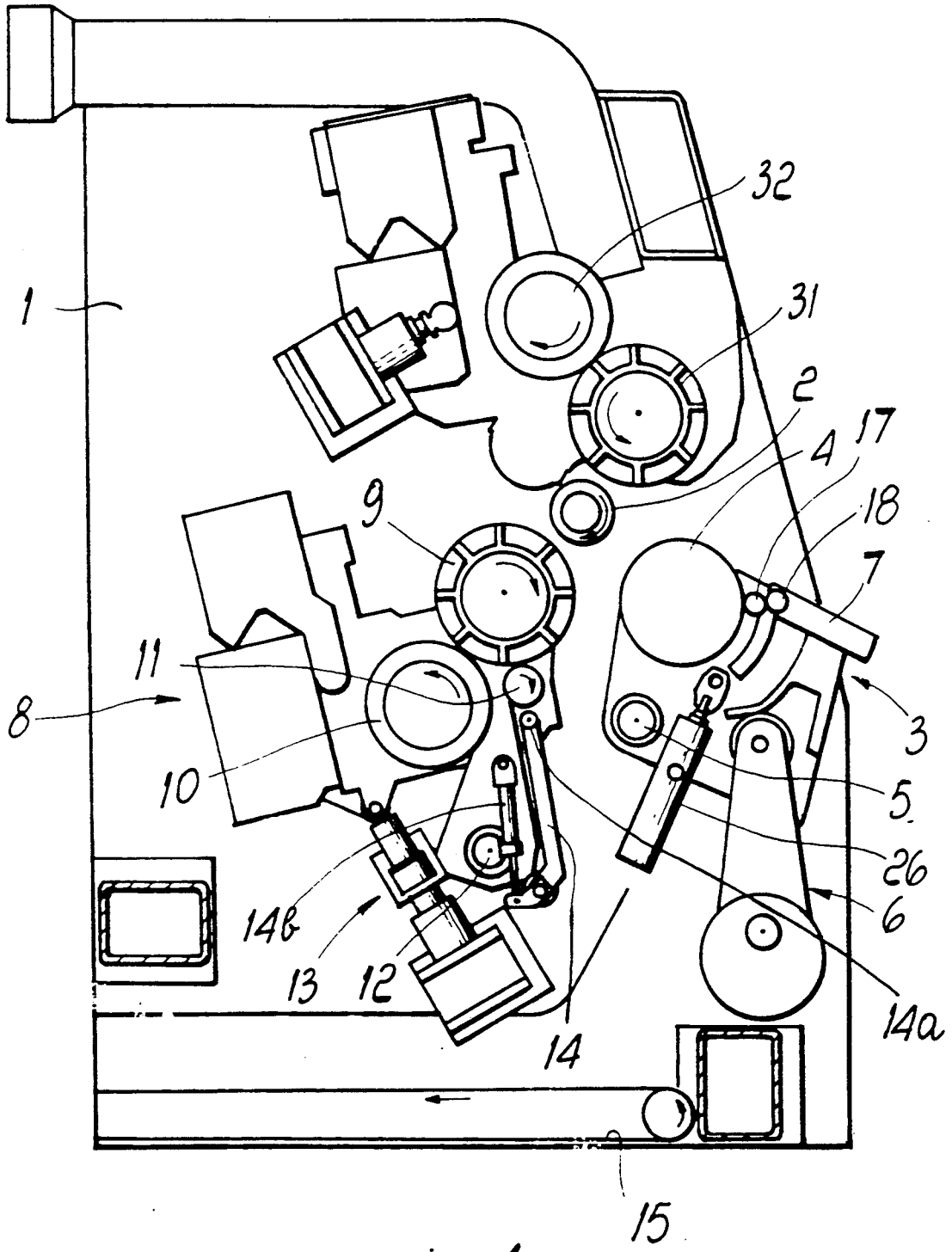
FIG. 1 is a schematic transverse sectional view of a machine according to the invention in the step of preparation for starting the processing.

With reference to the above figures, a machine according to the invention comprises a supporting structure which has two sides 1 between which a motorized cylinder 2 is rotatably retained and rotates clockwise according to the illustrated example.

Said driving cylinder 2 conveniently has a rubber-covered outer surface.

A first oscillating frame 3 is coupled between said two sides 1, in the front region of the machine, in a downward position with respect to said driving cylinder 2, and supports a support cylinder 4 which is rotationally coupled thereto, is free on its axis, conveniently has a larger diameter with respect to said driving cylinder 2 and has a chromed surface.

Conveniently, said first frame 3, which is articulated to an axis 5 which is arranged between the sides 1, is actuated by a cam device 6 and is movable between two positions in which the support cylinder 4 is respectively spaced and close to the driving cylinder 2.

Advantageously, said first oscillating frame 3 supports a movable feeding table 7 which is arranged substantially tangent to the support cylinder 4.

A second oscillating frame 8 is retained between the two sides 1, in the rear region of the machine, below said driving cylinder 2, and supports a first bladed cylinder 9 and a first sharpening assembly 10.

Said first bladed cylinder 9 is rotated, clockwise in the illustrated case, by a motor unit which is not shown in the figures and is supported on the frame of the machine.

A cylinder 11, suitable for separating the hide from the first bladed cylinder 9, is also rotationally coupled to said second oscillating frame 8.

As can be seen in the figures, said second oscillating frame 8 is articulated to an axis 12 and is coupled to an actuator 13 which is rigidly associated with the structure of the machine and is adapted to rotate said frame between two positions in which the bladed cylinder 9 is respectively spaced and close to the support cylinder 4.

A rod 14 is conveniently articulated to said second oscillating frame 8, extends upward and supports a free roller **14*a* adapted to guide the processed hide onto a lower conveyor belt 15** which moves it out of the machine.

Said rod 14 is actuated by an actuator **14*b* between a position in which the roller 14*a* is below the first bladed cylinder 9 and a position in which the roller 14*a* is below the support cylinder 4**.

According to the invention, a third frame 16 is coupled to the first frame 3 so as to be able to oscillate and supports a contrast cylinder 18 which is kinematically connected to said support cylinder 4 by means of a row of rollers 17 interposed therebetween.

Figure 5:
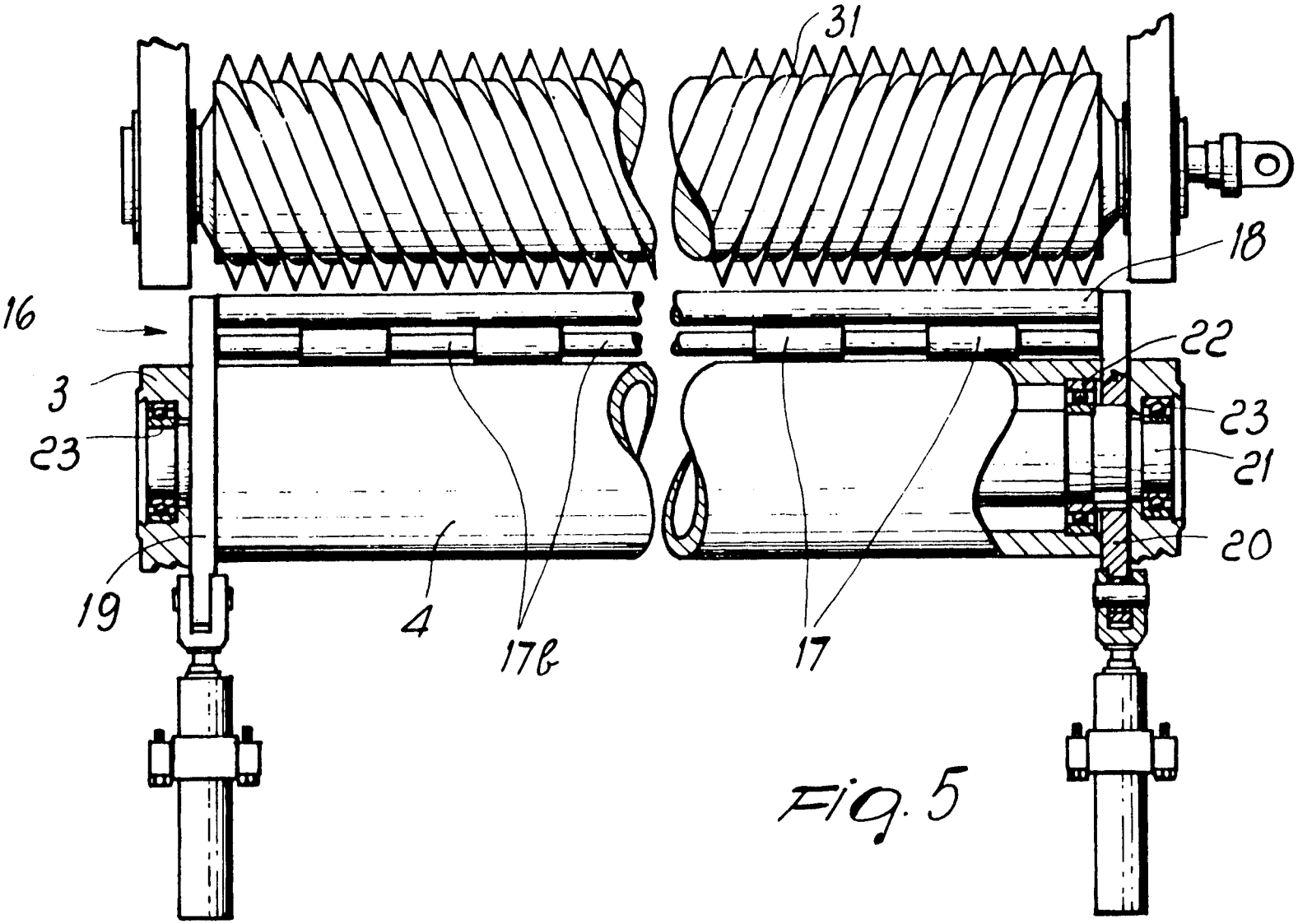
FIG. 5 is a front view of the front part of the machine of FIG. 1.
Figure 6:
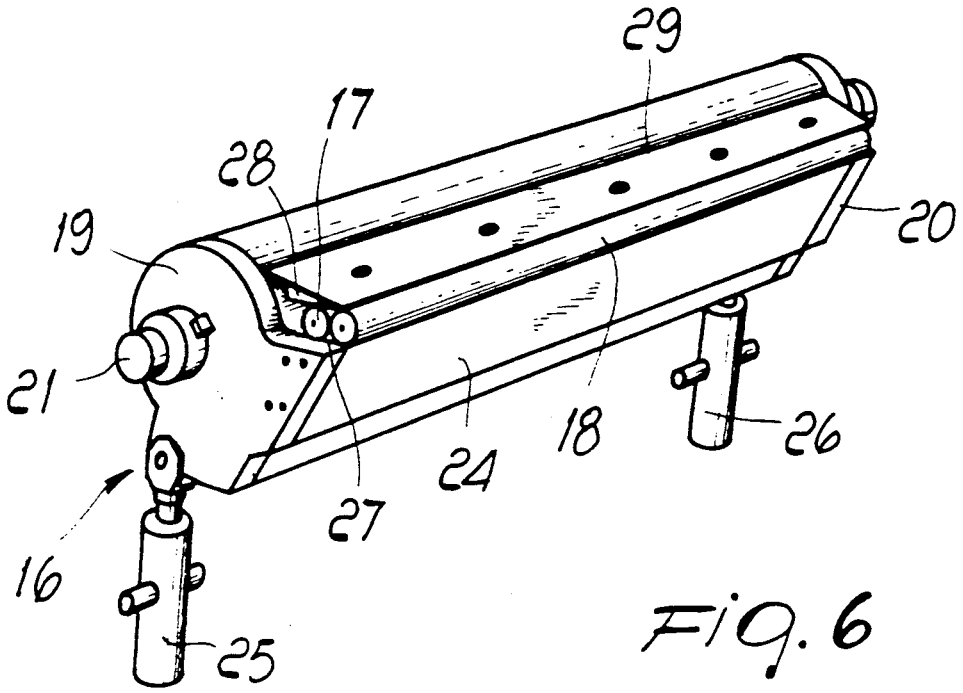
FIGS. 6 and 7 are perspective views, respectively in an idle position and in a working position, of a frame which is rotationally coupled to the axis of a hide supporting cylinder and is suitable for interposing a pair of rollers between said cylinder and a front bladed cylinder.
Figure 7:
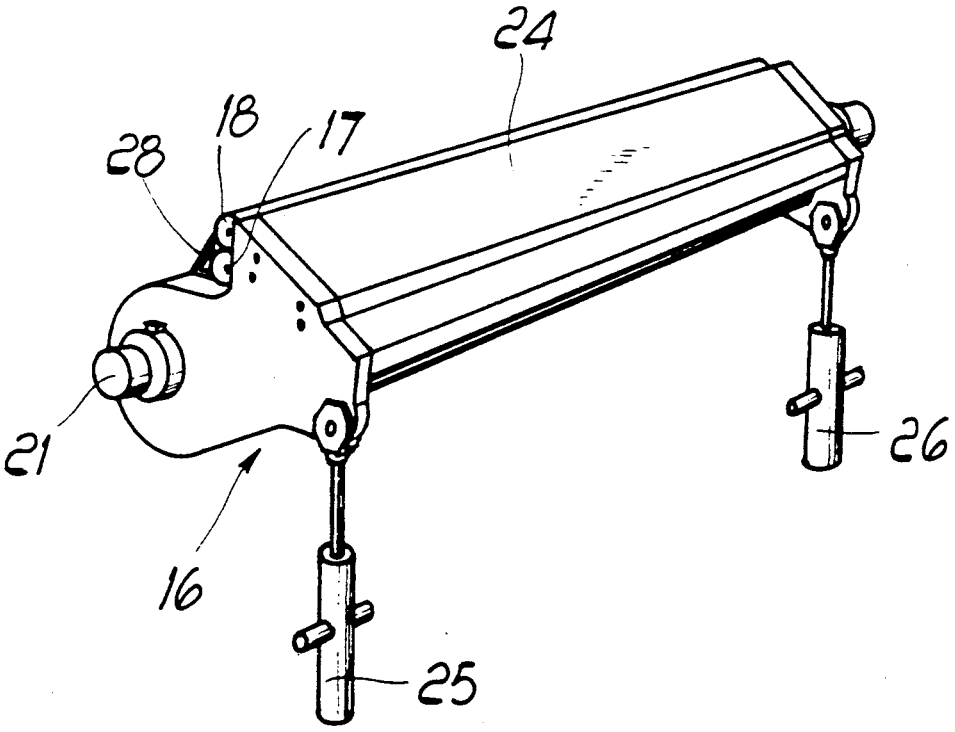
Figure 8:
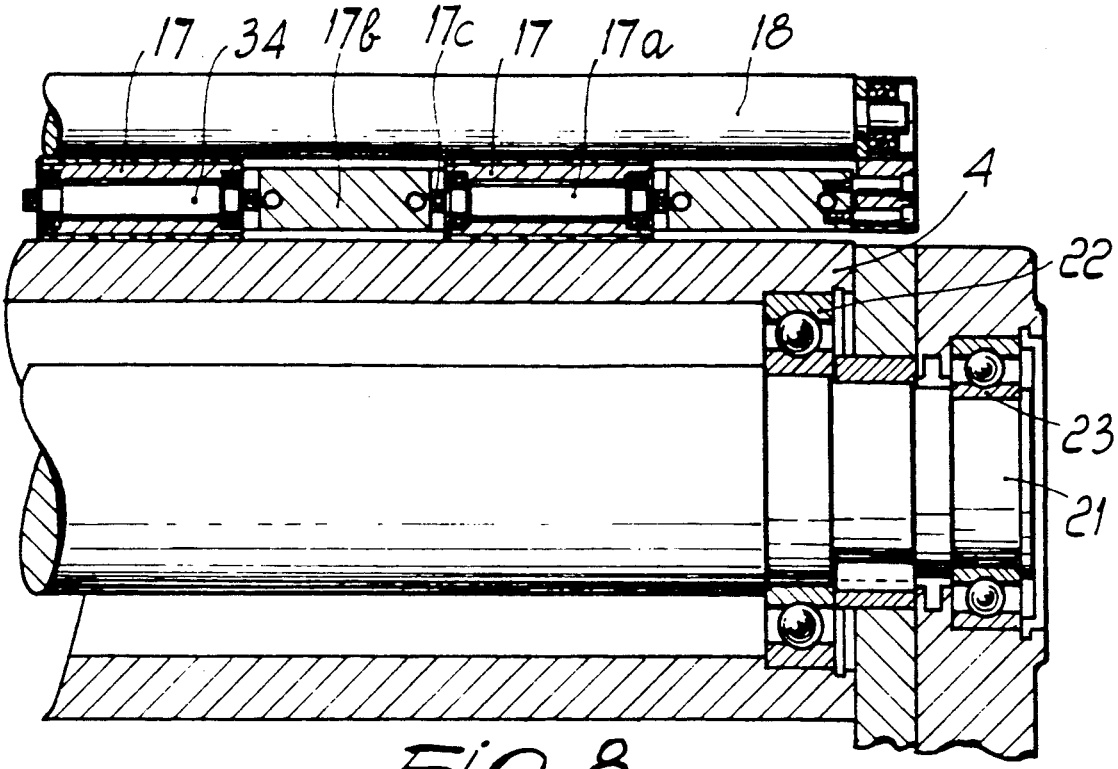
FIG. 8 is a sectional view of the rollers.
Figure 9:
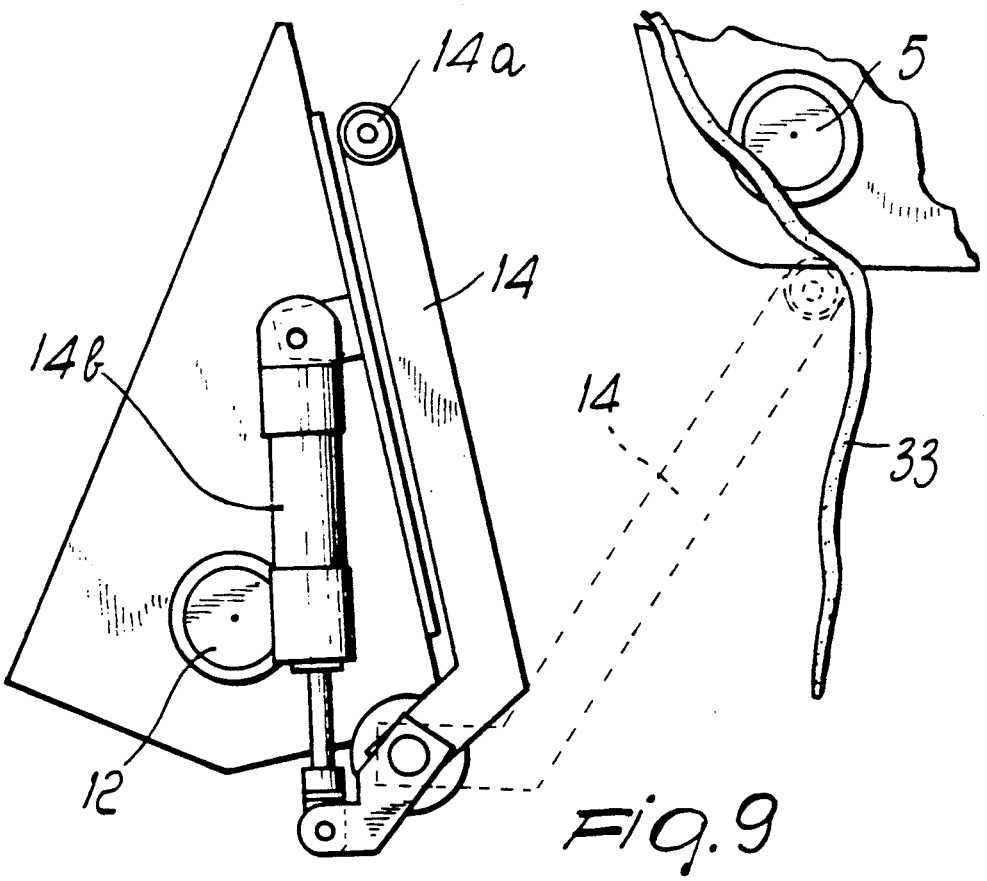
FIG. 9 is a view of the system for removing the hide after processing.

More in particular, said third frame 16 comprises two lever-like heads 19 and 20 which, as illustrated in figure 5, are rigidly associated with the axis of rotation 21 about which the support cylinder 4 is free to rotate, since it is supported thereon by bearings 22.

The axis of rotation 21 is also supported by bearings 23 which are arranged on the first oscillating frame 3.

The two lever-like heads 19 and 20 are joined by cross-members 24, and each head is coupled to a fluid-actuated jack, respectively 25 and 26.

The rollers 17 and the cylinder 18 are arranged in mutual contact with their axes on a radial plane with respect to the support cylinder 4 and are rotated by said cylinder due to the contact between the rolling surfaces.

The cylinder 18 is contained between two parallel scraping edges 27 and 28 defined on the third frame 16 and is conveniently free or can receive its motion, as previously mentioned, from the support cylinder 4.

Planar surfaces arranged frontward and rearward to the cylinder 18 for supporting the hide being processed are constituted by means of a cross-member 24 and a panel 29.

Conveniently, as illustrated in FIG. 5, said rollers 17, which are interposed between the cylinder 4 and the cylinder 18, are free, and covered with a plastic material such as for example a plastic sold under the trademark "Ertalite", so as to not ruin the surfaces in contact, which are both chromed. Each roller rotates about an internal core **17*a* which is free to move orthogonally to its own axis of symmetry but is rigidly associated with the structure of the third frame 16**.

The cores **17*a* are in fact separated from one another by spacers 17*b* which are associated therewith by means of jointed couplings 17*c***.

Still according to the invention, the two fluid-actuated jacks 25 and 26 are adapted to move the pair of rollers 17 and the cylinder 18 from a lower position to an upper position with said rollers interposed between the support cylinder 4 and a second bladed cylinder 31 which is rotatably coupled, in a preset position, in the front part of the machine above said support cylinder 4.

Conveniently, said second bladed cylinder 31 is associated with a second sharpening assembly 32 and is rotated in the opposite direction with respect to the driving cylinder 2, counterclockwise in this case, by a motor unit which is not illustrated and is supported on the frame of the machine.

The processing cycle of the machine, according to the invention, is as follows: at first the machine is arranged as shown in FIG. 1, the support cylinder 4 and the first bladed cylinder 9 in a raised position, so that an operator can lay the hide 33 on the table 7, arranging it with its grain side downward.

Figure 2:
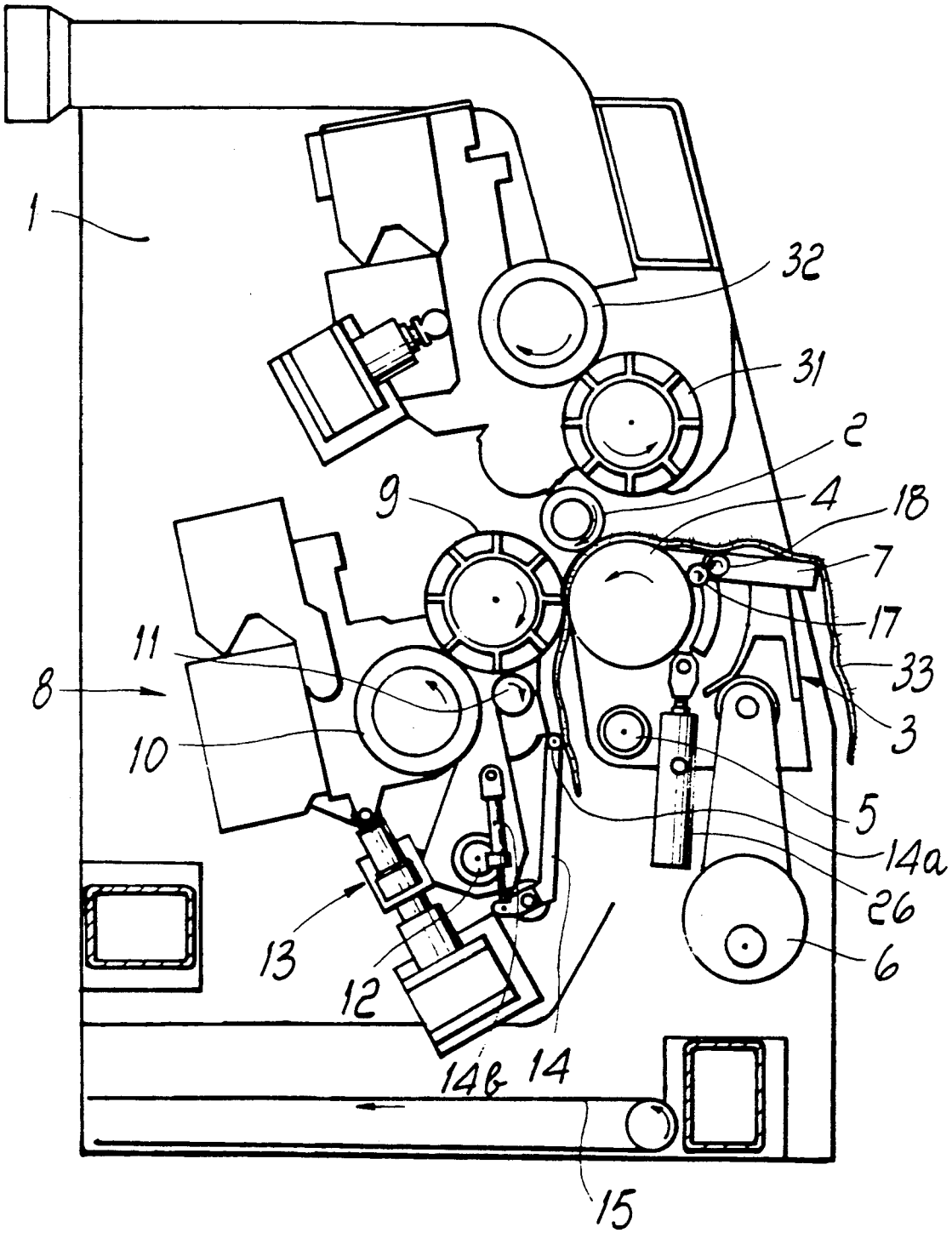
FIG. 2 is a view, similar to FIG. 1, of the machine during a first step of the processing.

The two frames 3 and 8 are then moved closer together so that the hide is clamped between the driving cylinder 2 and the support cylinder 4 and is then caused to advance toward the first bladed cylinder 9 which, as illustrated in FIG. 2, performs the skiving.

In this arrangement, the hide is skived for a predominant part of its extension, until a reference region, for example the brisket, reaches approximately the level of the second bladed cylinder 31.

Figure 3:
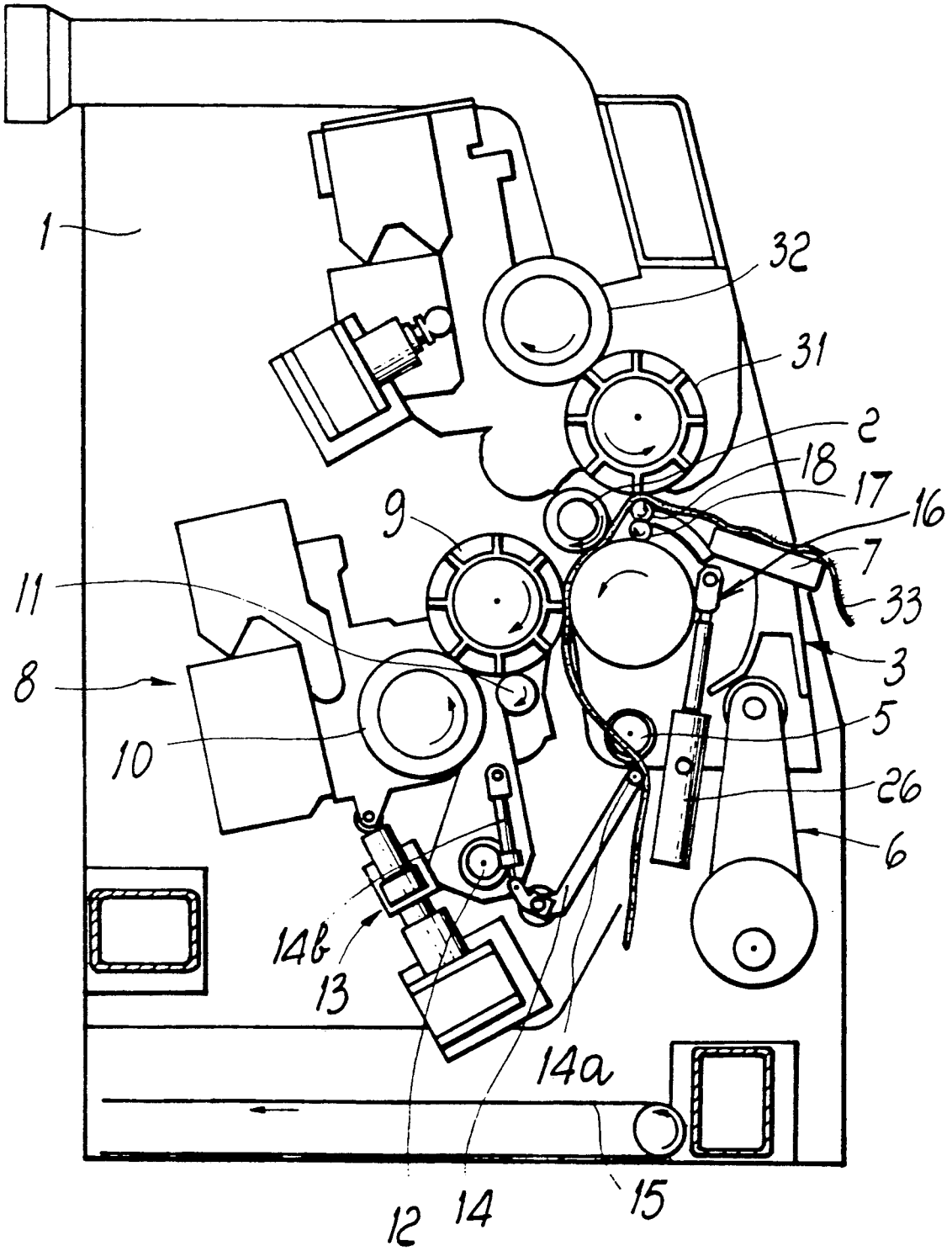
FIG. 3 is a view, similar to FIG. 1, of the machine during a second step of the processing.
Figure 4:
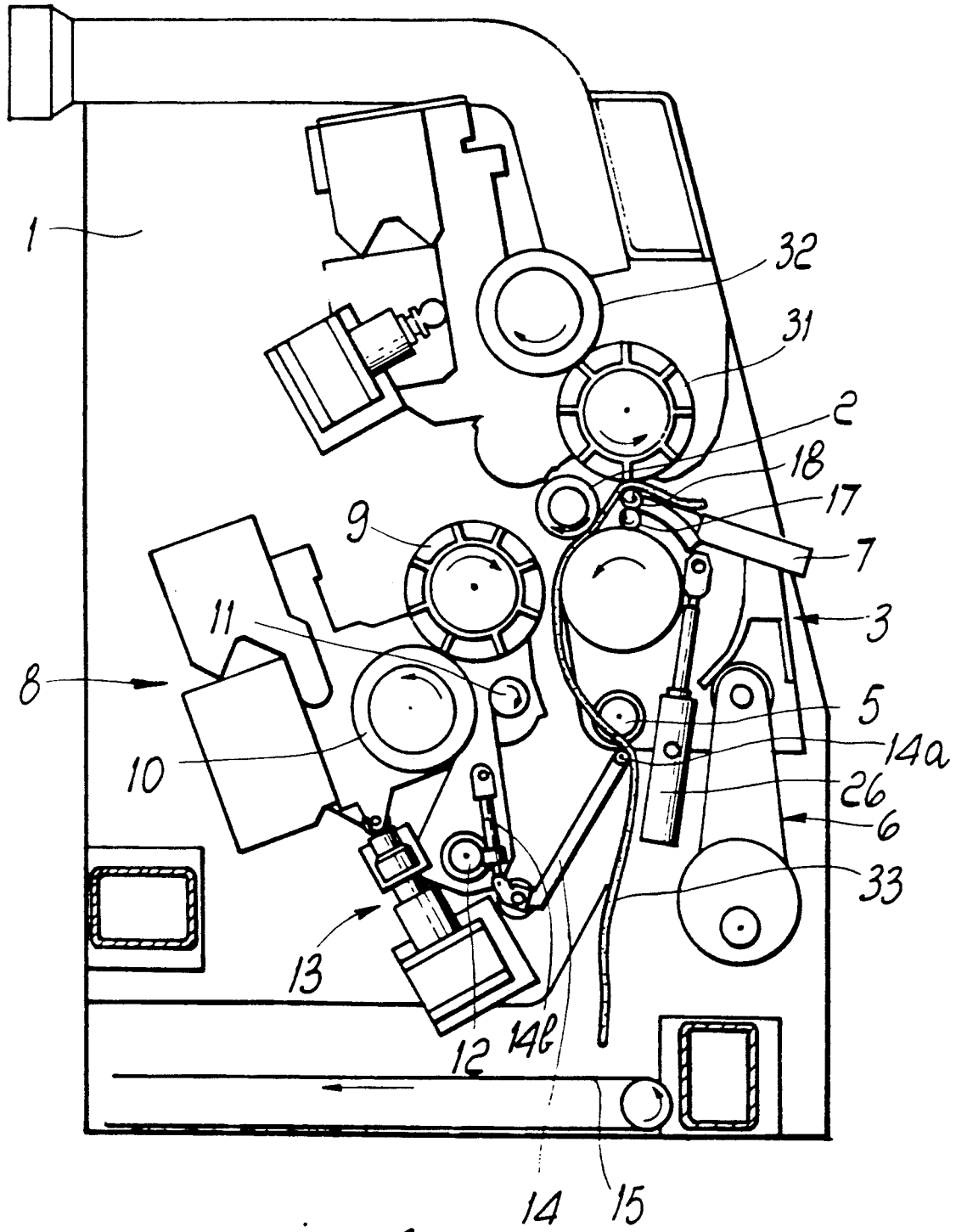
FIG. 4 is a view, similar to FIG. 1, of the machine during a third step of the processing.

At this point, the two rollers 17 and the cylinder 18 are lifted, as illustrated in FIG. 3, and said rollers and said cylinder interpose between the support cylinder 4 and the second bladed cylinder 31, raising the hide 33 and moving its final part to skiving.

The first bladed cylinder 9 performs the skiving until it reaches the point at which the skiving was begun by the second bladed cylinder 31, which is raised gradually from said position onward, spacing from the support cylinder 4, so as to not interfere with the further advancement of the hide 33 and not damage it.

The hide 33, upon the completion of the skiving, then disengages from the cylinders 2 and 4 and falls onto the conveyor belt 15 which carries it out of the machine.

It should be stressed at this point that the presence of the cylinder 18 and the consequent reduced support surface of the hide 33 during the second step of the skiving prevent the onset of tractions on said hide, due to the opposite rotary motion of the driving cylinder 2 and of the second bladed cylinder 31, of such an extent as to cause the brisket and the tip of the foreleg to tear.

Manual operations and the interventions of the operators on the hide are furthermore reduced to a minimum in this machine.

In practice it has thus been observed that the invention has achieved the intended aim and objects.

The machine according to the invention is susceptible to numerous modifications and variations, all of which are within the scope of the inventive concept.

All the details may furthermore be replaced with other technically equivalent elements.

In practice, the materials employed, as well as the dimensions, may be any according to the requirements.

We claim:

1. Hide skiving machine, comprising a supporting structure with two supporting sides, a driving cylinder rotatably connected to said sides, a first frame and a second frame both coupled in an oscillating manner to said sides, said first frame rotatably supporting a support cylinder which is arrangeable upon an oscillation of said first frame in a working position which is slightly forward and below said driving cylinder, thereby a hide being advanceable between said driving cylinder and said support cylinder, said second frame rotatably supporting a first bladed cylinder which is arrangeable upon an oscillation of said second frame in a working position which is slightly rearward of said support cylinder, thereby a hide being skivable between said support cylinder and said first bladed cylinder, said hide skiving machine further comprising a second bladed rotating cylinder rigidly associated with said supporting structure in a preset frontward position above said driving cylinder, and a third frame being associated with said first frame in an oscillating manner, said third frame supporting a contrast cylinder which is kinematically connected to said first support cylinder by means of a row of rollers interposed therebetween, said contrast cylinder and said rollers being arrangeable in a working position between said second bladed rotating cylinder and said support cylinder upon an oscillation of said third frame, thereby a selected skiving of a hide being effected between said contrast cylinder and said second bladed rotating cylinder.

2. Machine according to claim 1, wherein said contrast cylinder is much smaller in diameter than said support cylinder and has a chromed rolling surface.

3. Machine according to claim 1, wherein said first oscillating frame is articulated to a lower axis which is arranged between said two sides and is actuated by a cam actuator between lowered position and a raised position so that said support cylinder presses a hide being processed against said driving cylinder, said first frame comprising, in an upper region thereof, a movable table for an insertion of a hide into the machine.

4. Machine according to claim 1, wherein said support cylinder has a chromed rolling surface.

5. Machine according to claim 1, wherein said support cylinder is rotationally coupled to an axis of rotation which is in turn rigidly rotationally associated with said first frame.

6. Machine according to claim 1, wherein said second oscillating frame is rotatable about a lower axis of rotation between a position in which said first bladed cylinder is spaced from said support cylinder and a position in which said bladed cylinder is close to said support cylinder by means of an actuation device, said first bladed cylinder being associated with a first sharpening assembly and a cylinder being arranged below said first bladed cylinder for separating a hide therefrom.

7. Machine according to claim 5, wherein said third frame comprises two opposite lever-like heads which are rigidly associated with said axis on which said support cylinder rotates, each head being associated in a downward position with a fluid-actuated cyclinder, said heads being joined by cross-members and having panels so as to form support planes for a hide frontward and rearward of said rollers.

8. Machine according to claim 1, wherein said contrast cylinder is motorized by means of said support cylinder and said rollers due to mutual contact, said contrast cylinder being guided between two parallel scraping edges.

9. Machine according to claim 1, wherein said rollers are free and covered with plastic material, each of said rollers rotating about a corresponding core, each core being separated from the adjacent ones by means of a spacer, said cores and said spacers being associated by means of jointed couplings so that the rollers can move orthogonally to the axis which joins them.

10. Machine according to claim 1, wherein said second rotating bladed cylinder is associated with a second sharpening assembly arranged above it.

11. Machine according to claim 1, wherein a rod is articulated to said second oscillating frame, extends upward, and supports a free roller for guiding a processed hide onto a lower unloading conveyor belt, said free roller being actuated by an actuator between a position in which the roller is below said first bladed cylinder and a position in which roller is adjacent to said support cylinder.

* * * * *